US005881433A

United States Patent [19]

Mutone et al.

[11] Patent Number: 5,881,433

[45] Date of Patent: Mar. 16, 1999

[54] DOOR KNOB LEVER

[75] Inventors: Edward J. Mutone, Pomona; Mitchell I. Rapoport, Woodstock; Gregory R. Becker, Red Hook, all of N.Y.

[73] Assignee: Independent Living Products LLC, Congers, N.Y.

[21] Appl. No.: 874,306

[22] Filed: Jun. 13, 1997

[51] Int. Cl.[6] ..... B25G 3/28

[52] U.S. Cl. ..... 16/114 R; 16/DIG. 30; 292/336.3

[58] Field of Search ..... 16/114 R, 110 R, 16/DIG. 30; 292/336.3, 347, DIG. 2

[56] References Cited

U.S. PATENT DOCUMENTS

| | | | |
|---|---|---|---|
| 2,801,122 | 7/1957 | Sutter | 16/114 R |
| 4,223,931 | 9/1980 | Neary | 16/DIG. 30 |
| 4,285,536 | 8/1981 | McCoy et al. | 292/336.3 |
| 5,288,116 | 2/1994 | Donofrio | 292/347 |
| 5,638,576 | 6/1997 | Mutone | 16/DIG. 30 |

*Primary Examiner*—Chuck Y. Mah
*Assistant Examiner*—Donald M. Gurley

[57] ABSTRACT

A door knob lever for use by disabled persons to assist in turning a door knob. A truncated bracket including a central section and two sloping sections extending from the central section is provided with a handle extending, substantially at right angles from one side of the central section of the truncated bracket and a hook plate extending, also substantially at right angles, from the opposite side of the central section of the truncated bracket and extending in the opposite direction as the handle. Friction pads are secured to the two sloping sections of the truncated bracket to grip a door knob when the hook plate is about the neck of the door knob to cause movement of the ball of the door knob by movement of the lever.

6 Claims, 3 Drawing Sheets

SECTION 1-1

DOOR KNOB LEVER

FIELD OF THE INVENTION

This invention relates to a door knob lever and more particularly to an improved door knob lever for use by persons having restricted use of their hands which makes difficult the turning of a door knob to open a door. Even more particularly, this invention relates to such a door knob lever which is essentially formed in one piece at a limited production cost.

BACKGROUND OF THE INVENTION

In a co-pending patent application, Ser. No. 08/561,426, filed Nov. 21, 1995, of Edward J. Mutone, now U.S. Pat. No. 5,638,576 and assigned to a common assignee, a unique and highly desirable door knob lever is disclosed which provides a door knob lever which can be readily used by a disabled person. In that patent application, a discussion of the prior art is set forth and reference is made to that application for such background information. The Door Knob Lever, however, taught in that patent application, is a comparatively complex device, which is comparatively expensive to manufacture. In view of the need for such a device by persons, many of whom have limited financial abilities, it is most beneficial that the maximum number of persons requiring such a door knob lever will be able to obtain one.

Accordingly, it is an object of the present invention to provide a door knob lever that can be used on door knobs having different sizes.

Accordingly, it is another object of the present invention to provide a door knob lever which is easily carried and utilized by a person having restricted physical ability.

Accordingly, it is another object of the present invention to provide a door knob lever which is simple and durable.

Accordingly, it is another object of the present invention to provide a door knob lever which is economical to produce and to maintain.

Other objects and advantages of the present invention will become apparent to those of ordinary skill in the art as the description thereof proceeds.

SUMMARY OF THE INVENTION

A Door Knob Lever is provided with a truncated bracket having a lever secured to and extending from one side of the truncated bracket and a hook plate secured to and extending from the opposite end of the truncated bracket and extending in the opposite direction from the lever. Frictional pads are mounted inside the truncated bracket.

DESCRIPTION OF THE PREFERRED EMBODIMENT

Figure 1:
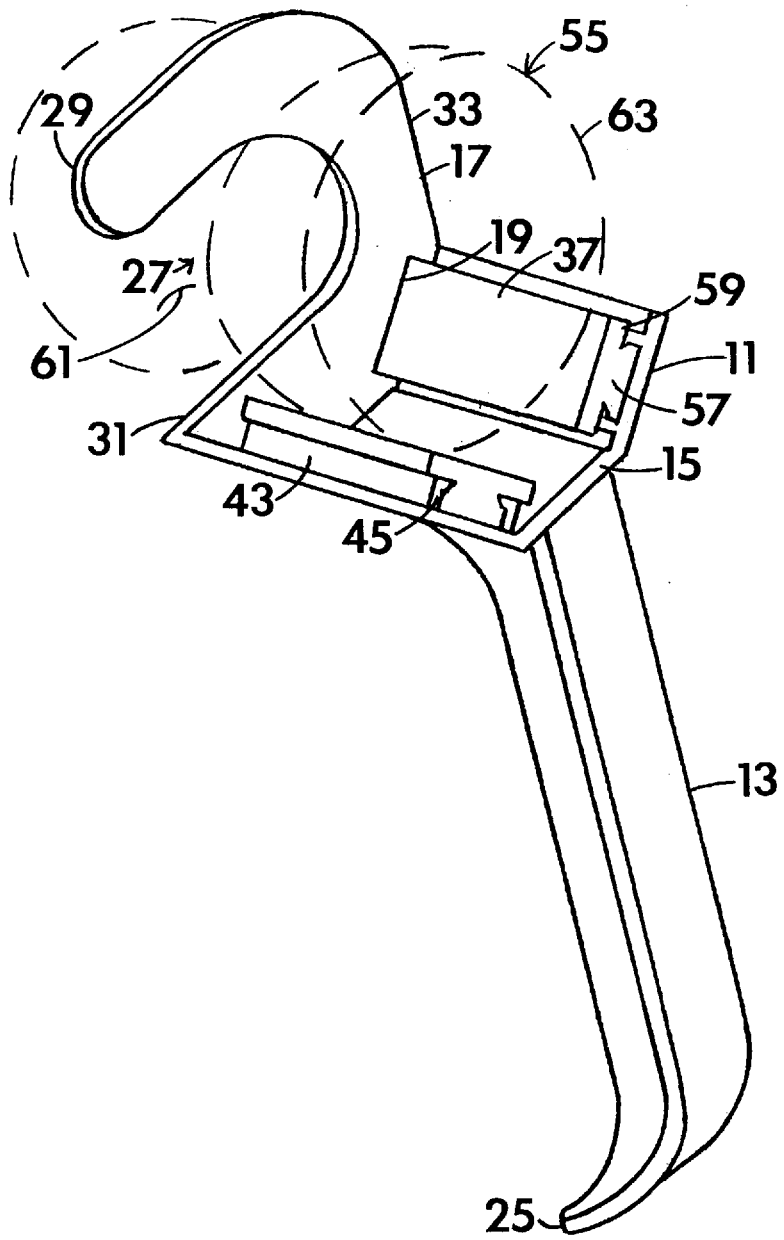
FIG. 1 is a pictorial view of the door knob lever mounted on a door knob shown in italics.

Referring now to FIG. 1, the Door Knob Lever is shown having a truncated bracket 11 with a handle 13 secured to and extending from one side 15 of the truncated bracket 11 and a hook plate 17 secured to the opposite side 19 of the truncated bracket 11 and extending from the truncated bracket 11 in the opposite direction as the handle 13 extends from the truncated bracket 11. The truncated bracket 11 includes a central section 21 and two sloping sections 23. The central section 21 is preferable rectangular as are the two sloping sections 23. Each of the two sloping sections 27 form an obtuse angle, substantially the same obtuse angle, with the central section 21. The handle 13 is secured to the central section 21. The handle 13 extends from the central section 21 in the opposite direction from the direction that the sloping sections 23 extend from the central section 21. The hook plate 17 also is secure to the central section 21 of the truncated bracket 11. It is contemplated that the truncated bracket 11 and the handle 13 and the hook plate 17 are all formed together, as for example, from a high strength plastic that can be inexpensively molded. The hook plate 17 extends in the opposite direction from the central section 21 as does the handle 13 and the hook plate 17 therefore extends in the same direction from the central section 21 as do the sloping sections 23 of the truncated bracket 11. Substantially, the handle 13 and the hook plate 17 are parallel to one another and are located generally at right angles to the central section 21 of the truncated bracket 11.

The handle 13 can be formed in any number off styles but as shown in FIG. 1, a handle 13 with a curved cross-section and with the tip 25 of the handle 13 slightly bent over to retain the hand on the handle 13. A cushion may be wrapped about the handle 13 for comfort.

The hook plate 17 has a U-shaped opening 27 forming a finger 29 remote from the truncated bracket 11. The hook plate 17 has an upper member 31 which is secured to the truncated bracket 11 and a back member 33 which connects the finger 29 to the upper member 31 about the U-shaped opening 27. As also shown in FIG. 1, with the handle 13 directed downward and closest to the user and the hook plate 17 to the rear, the U-shaped opening 27 extends from the left toward the back member 33 to the right. Reversing the position of the U-shaped opening 27, reverses the direction of rotation of the Door Knob Lever when in use.

The two sloping sections 23 of the truncated bracket 11 have inside surfaces 35 which generally oppose one another inside the truncated bracket 11. On these inside surfaces 35 of the sloping sections 23, friction pads 37 are mounted. The friction pads 37 have an outside surface 39 opposite from an interior surface 41 which is mounted against the inside surfaces 35 of the sloping sections 23. The outside surface 39 of the friction pads 37 preferably has a waffle-like or square-ridged surface but other surfaces are also usable.

Figure 2:
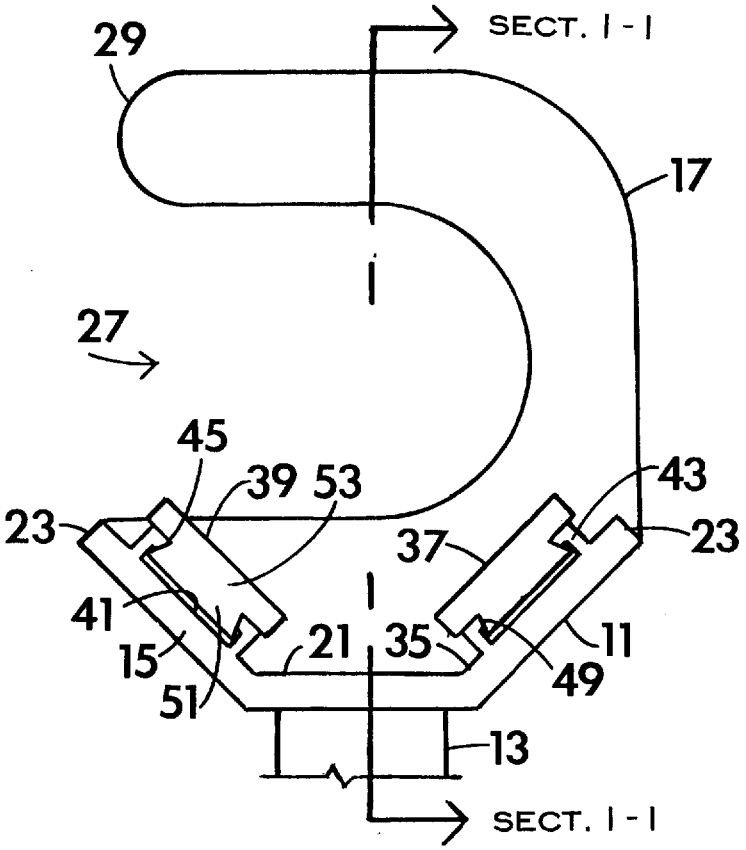
FIG. 2 is a side elevation of the hook plate and the truncated bracket with the friction pads in place.
Figure 3:
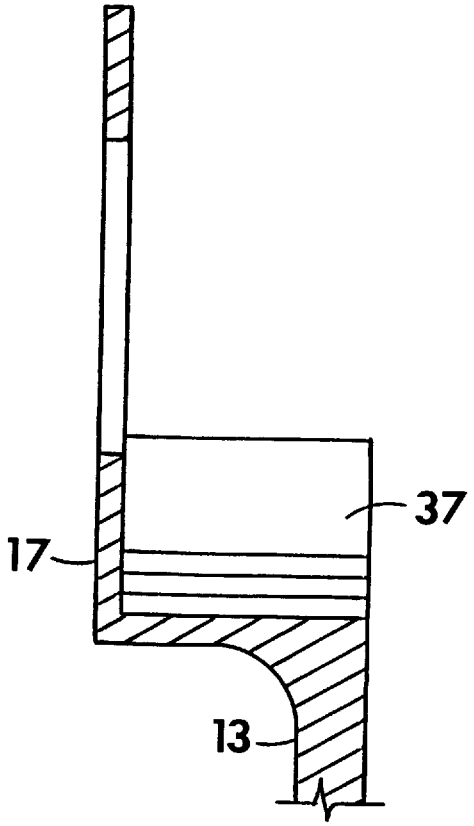
FIG. 3 is a cross-sectional view along lines A—A of FIG. 2.

The one part of the Door Knob Lever which will wear with time is the friction pads 37 and thus replacement of the frictional pads 37 is a benefit, if low cost maintenance of the Door Knob Lever is to be achieved. Thus, on each of the inside surfaces 35 of the sloping sections 23, a pair of opposed L-shaped brackets 43 are formed. Each L-shaped bracket 43 has a leg 45 which is secured to the inside surface 35 of the sloping sections 23 at substantially right angles to the inside surface 35 with protrusions 47 located at the end of the legs 45 at substantially right angles to the legs 45. The protrusions 47 of each pair of legs 45 are directed toward one another. As seen in FIG. 1, the legs 45 and the protrusions 47 are elongated extending substantially from one side 15 of the truncated bracket 11 to the other side 19. Each of the protrusions 47 is cut off at an angle 49 so to slope inwardly to the leg 45 on which it is mounted and to the inside surface 35. Each friction pad 37 has a base section 51 and a top section 53. The top section 53 is used to engage the door knob 55 to be opened. The outside surface 39 of the friction pads 37 are rectangular and the entire top section 53 is rectangular. Each friction pad 37 has two sides 57 which are placed generally parallel with the side 15,19 of the truncated bracket 11. Each friction pad 37 has two edges 59, which are generally longer than the sides 57. When the friction pads 37 are in place, the edges 59 extend from one side 15 of the truncated bracket 11 to the other side 19 and generally are at right angles to the sides 15,19 of the truncated bracket 11. The base section 51 of each friction pad 37 is indented and is dovetailed along its edges 59, so the base section 51 along the edges slopes inwardly toward the top section 53. In this way, as best seen in FIG. 1 and FIG. 2, base section 51 is slid between the two L-shaped brackets 43 and thereby are held in place on the sloping sections 23 but the friction pads 37 may also be slid out from within the L-shaped brackets 43 and thus may be readily replaced.

The design of the Door Knob Lever makes its use very convenient for the person using it. As best seen in FIG. 1, the finger 29 of the hook plate 17 is slipped under the neck 61 of the door knob 55. The handle 13 is grasped comfortably in the hand and is then rotated to press the two friction pads 37 against the ball 63 of the door knob 55. The rotation is continued and as the rotation continues the finger 29 is pulled tight against the neck 61 of the door knob 55 and the friction pads 37 press firmly against the ball 63 of the door knob 55 and the door knob 55 is turned easily with substantial mechanical advantage from the handle 13. Once the door is opened, the Door Knob Lever is rotated in the opposite direction slightly to release the finger 29 and the friction pads 37 and the Door Knob Lever is retained for use on any other door knob.

It is to be understood that the drawings and description matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

The claims are:

1. A Door Knob Lever to provide assistance in opening a door, the Door Knob Lever comprising:

a truncated bracket including a central section and two sloping sections, the two sloping sections being affixed to the central section at an obtuse angle to the central section, the obtuse angle for each sloping section being substantially the same obtuse angle, each sloping section having an inside surface, the two inside surfaces generally facing one another, the truncated bracket having two opposite sides with the central and sloping sections extending therebetween a handle affixed to the central section at one side of the truncated bracket, the handle extending substantially from the central section in a direction away from the central section;

a hook plate rigidly affixed to the central section on the side of the truncated bracket opposite from the handle, the hook plate extending from the central section in an opposite direction that, in which the handle extends from the central section, the hook plate having a U-shaped opening in it;

a pair of friction pads; and means for retaining the pair of friction pads on the inside surface of the sloping sections.

2. A Door Knob Lever according to claim 1 wherein the means for retaining comprises means for removeably retaining the pair of friction pads.

3. A Door Knob Lever according to claim 1 wherein the means for retaining the pair of friction pads includes L-shaped brackets affixed to the inside surface of the sloping sections.

4. A Door Knob Lever according to claim 1 wherein the hook plate and the handle are both extending substantially at right angles to the central section.

5. A Door Knob Lever according to claim 1 wherein the central section and the two sloping sections are rectangular.

6. A Door Knob Lever to provide assistance in opening a door, the Door Knob Lever comprising:

a truncated bracket including a central section and two sloping sections, the central section and the two sloping sections being rectangular, the two sloping sections being affixed to the central section at an obtuse angle to the central section, the obtuse angle for each sloping section being substantially the same obtuse angle, each sloping surface having an inside surface, the two inside surfaces generally facing one another, the truncated bracket having two opposite sides with the central and slopping sections extending therebetween;

a handle affixed to the central section at one side of the truncated bracket, the handle extending substantially at right angles to the central section in a direction away from the central section;

a hook plate rigidly affixed to the central section on the side of the truncated bracket opposite from the handle, the hook plate being substantially at right angles to the central section and extending from the central section in an opposite direction from that in which the handle extends from the central section, the hook plate having a U-shaped opening in it, the hook plate being aligned substantially with the handle;

a pair of L-shaped brackets affixed to each sloping section, the L-shaped brackets extending from one side of the truncated bracket to the other side of the truncated bracket in a generally parallel relationship and facing towards one another to form a channel; and a pair of friction pads, each having a top section and a base section, the base section being dove-tailed to slide between the L-shaped brackets and be retained by the L-shaped brackets.

* * * * *